US005790027A

United States Patent [19]

Chern

[11] Patent Number: 5,790,027

[45] Date of Patent: Aug. 4, 1998

[54] CARD SAFETY WALLET AND SAFETY INSERT

[75] Inventor: Elite Chern, Taipei, Taiwan

[73] Assignee: Alexander USA, LLC, Washington, D.C.

[21] Appl. No.: 731,226

[22] Filed: Oct. 11, 1996

[51] Int. Cl.[6] ..... G08B 13/14

[52] U.S. Cl. ..... 340/568; 340/522; 340/571

[58] Field of Search ..... 340/568, 571, 340/522; 200/61.19, 61.59, 61.63

[56] References Cited

U.S. PATENT DOCUMENTS

| | | | |
|---|---|---|---|
| 3,959,789 | 5/1976 | McGahee | 340/568 |
| 4,480,250 | 10/1984 | McNeely | 340/568 |
| 4,652,865 | 3/1987 | Maharshak | 340/568 |
| 4,692,745 | 9/1987 | Simanowitz | 340/568 |
| 4,717,908 | 1/1988 | Phillips et al. | 340/568 |
| 4,719,453 | 1/1988 | Beck et al. | 340/568 |
| 4,721,948 | 1/1988 | Lin | 340/568 |
| 4,890,094 | 12/1989 | Kopel | 340/571 |
| 4,916,434 | 4/1990 | McNeely | 340/568 |
| 5,034,724 | 7/1991 | Tone | 340/571 |
| 5,053,749 | 10/1991 | Weiss | 340/568 |
| 5,272,319 | 12/1993 | Rey | 235/379 |
| 5,373,283 | 12/1994 | Maharshak | 340/568 |
| 5,418,520 | 5/1995 | Hirshberg | 340/568 |

*Primary Examiner*—Brent A. Swarthout
*Assistant Examiner*—Van T. Trieu
*Attorney, Agent, or Firm*—Bradford E. Kile; Karan Singh

[57] ABSTRACT

A safety wallet having an alarm system for detecting a missing or partially inserted card or similar object. At least one pocket or compartment for retaining cards or similar objects is provided with opposing films of conductive material on a dielectric material base. An alarm circuit board is electrically connected with the conductive films such that an audio alarm is activated when the wallet is closed without a card in at least one pocket and the alarm is not activated when cards or similar objects are fully inserted in all the pockets.

21 Claims, 2 Drawing Sheets

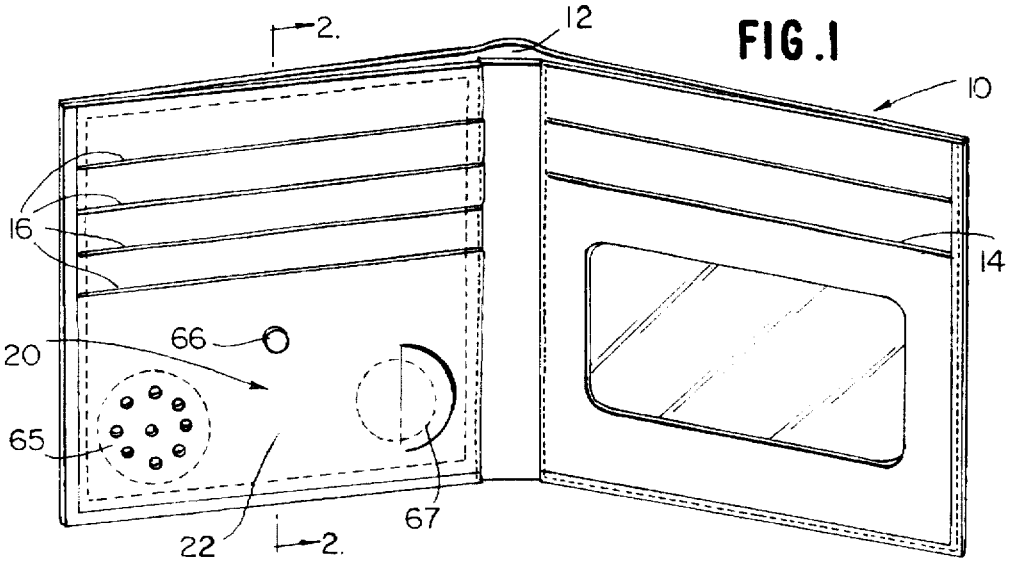
FIG.1
FIG.8
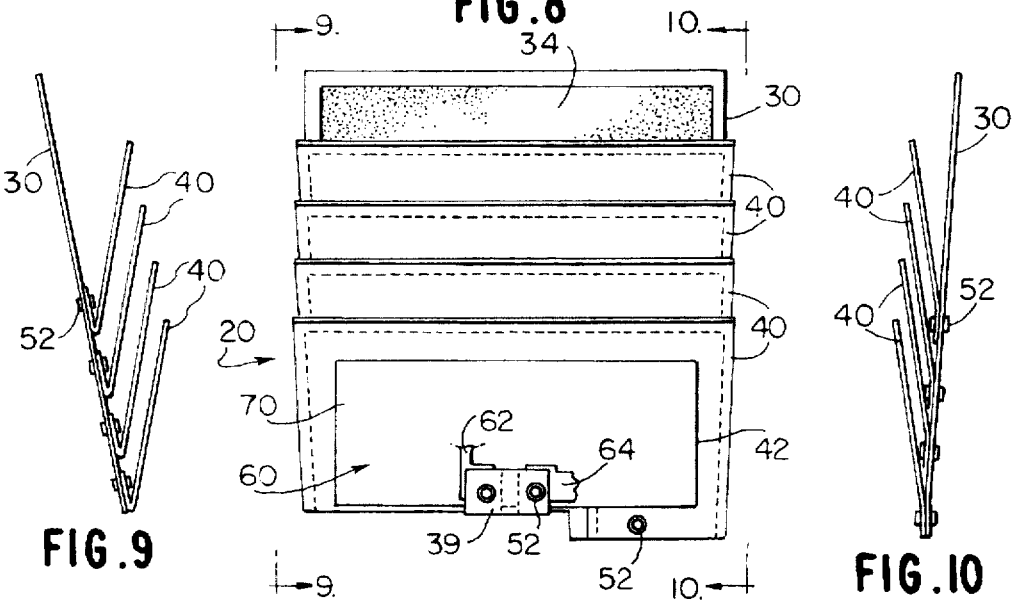
FIG.9
FIG.10
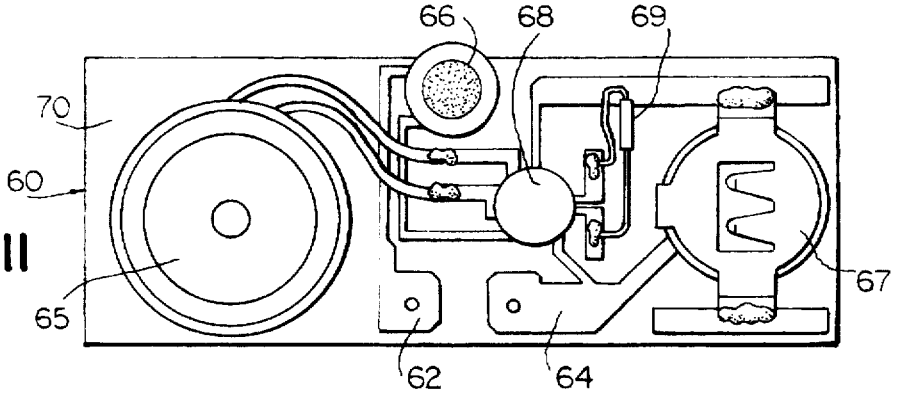
FIG.11

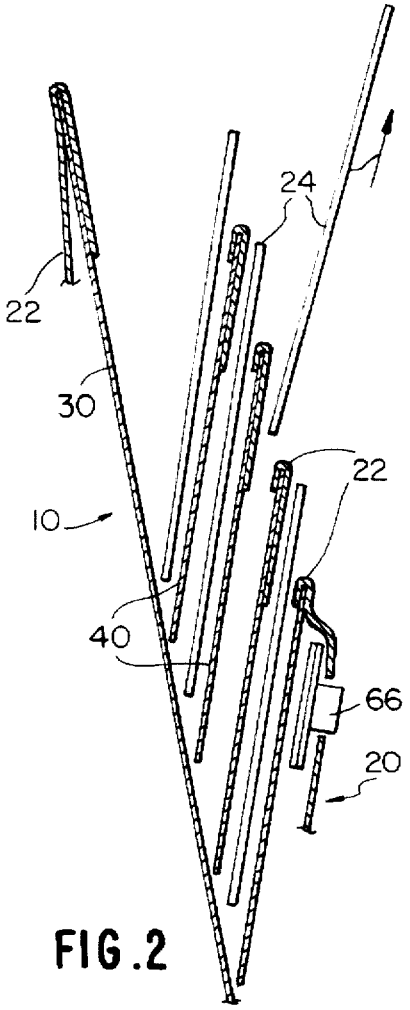
FIG.2
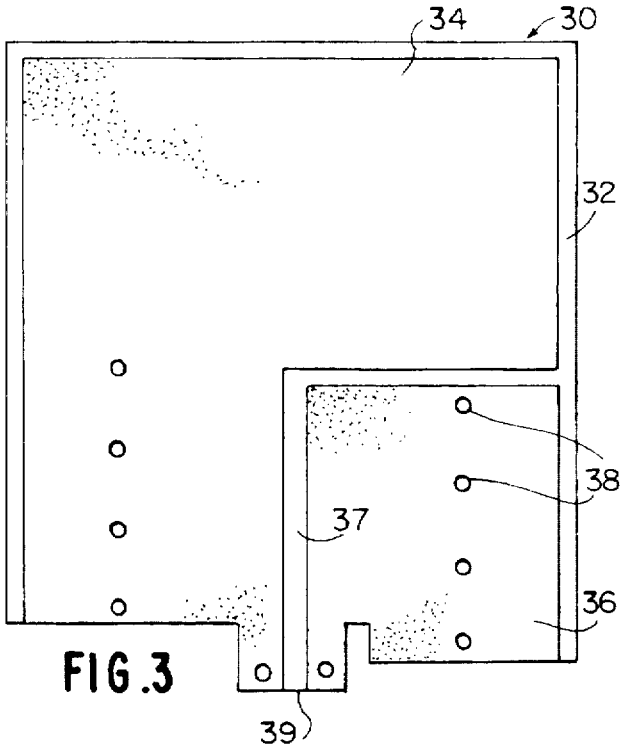
FIG.3
FIG.4
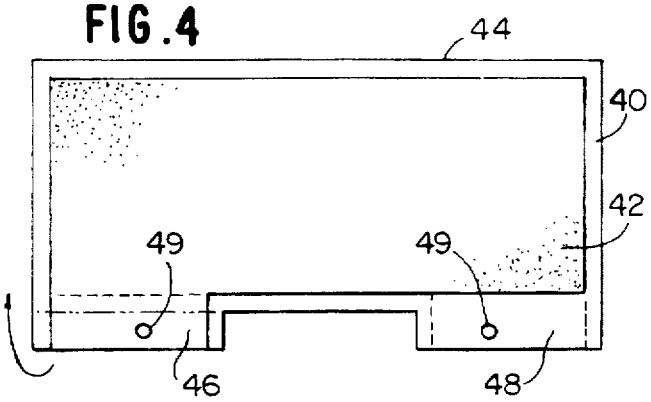
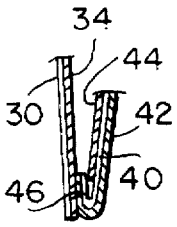
FIG.6
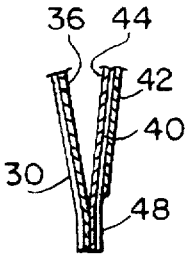
FIG.7
FIG.5
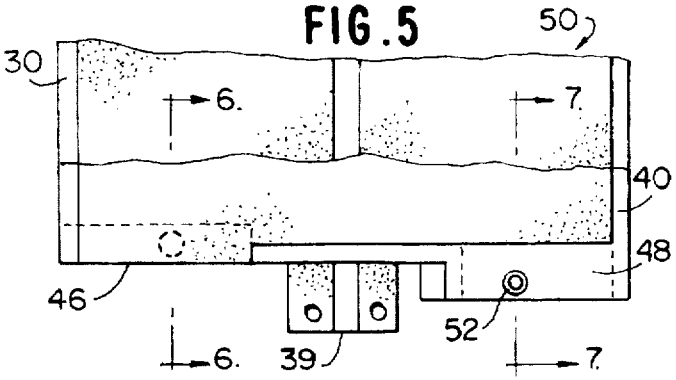

CARD SAFETY WALLET AND SAFETY INSERT

BACKGROUND OF THE INVENTION

The present invention relates to a card safety wallet and safety insert having compartments or pockets for retaining credit cards, bank cards, electronic pay cards, driver licenses, identification cards, check cards, debit cards, smart cards, other similar objects, and similar cards not yet known. More specifically, the invention relates to a wallet-like structure and a safety insert having an alarm system for alerting a user when an item previously retained is removed and the wallet is closed without replacing the item in its pocket.

Often credit cards, driver licenses, electronic pay cards, identification cards, check cards, debit cards, smart cards, and other similar objects are lost or misplaced because an owner forgets to reclaim his/her card after its use. Typically, the missing item is removed from a wallet, or the like, and given to another person after which it is not returned to its owner who forgets to reclaim it and closes the wallet without securing the missing item. This type of card loss often causes inconvenience and in certain instances a loss can be the equivalent of losing cash.

Wallets with alarm systems to indicate to the owner that a credit card is missing have previously envisioned. One prior system discloses a wallet structure with a card monitoring and alarm system having resilient cushioning pads to urge contact points together in the absence of a credit card or pay card, thereby setting off an alarm when the wallet is closed. This device, however, requires a great deal of assembly and material to produce, making it expensive to product without apparent advantages.

Another design teaches an alarm system for a cardholder having a control circuit with an interrupted loop of conductive material and a contact element which bridges a pair of adjacent but separate leads to close the circuit when the cardholder is closed without a card in at least one of a plurality of interconnected flexible pockets. This prior art invention, however, requires a contact element to bridge adjacent leads which adds complexity to the assembly process making it inefficient and more expensive to produce and also allowing greater potential for failure to operate correctly.

The prior art discussed above is not intended to be exhaustive, but rather demonstrates that room for significant improvement exists and that there is need for an improved alarm system to detect when a credit card or the like is missing from a wallet or cardholder.

OBJECTS AND BRIEF SUMMARY OF THE INVENTION

OBJECTS OF THE INVENTION

An object of the invention is to provide a card safety wallet and safety insert for a wallet that will obviate or minimize difficulties of the type previously described.

Another object of the invention is to provide a card safety wallet and safety insert that emits an audible alarm when the wallet is closed without a credit card or similar object being returned to its previous location in the wallet after having been removed.

A further object of the invention is to provide a card safety wallet and safety insert in which the electronic circuitry and materials of the alarm system do not add significantly to the weight of the wallet.

Yet another object of the invention is to provide a card safety wallet and safety insert in which the electronic circuitry and materials of the alarm system do not add significantly to the bulk and thickness of the wallet.

Yet another object of the invention is to provide card safety wallet and safety insert in which the electronic circuitry and materials of the alarm system do not detract from the aesthetics of the wallet.

A further object of the invention is to provide a card safety wallet and safety insert which emits an audible alarm alerting the owner when the wallet is closed and a credit card or the like is not fully and securely fit into the card receptacle.

A further object of the invention is to provide a card safety wallet and safety insert which is relatively inexpensive to manufacture and reliable and rugged in use.

BRIEF SUMMARY OF A PREFERRED EMBODIMENT OF THE INVENTION

A preferred embodiment of the invention that is intended to accomplish at least some of the foregoing objects comprises a billfold type wallet having a card safety alarm system and safety insert fitted into the pockets or compartments of the wallet. The pockets or compartments may be sized for retaining credit cards, bank cards, debit cards, driver licenses, identification cards, check cards, smart cards and other similar objects. The alarm system includes one larger back piece or base panel and one or more smaller, overlying front pieces, or leaf panels, which are attached to the larger base panel to form one or more pockets or compartments for retaining the credit cards or the like.

The larger back piece is composed of a dielectric material, such as plastic, with two areas or sections of electrically conductive film deposited on a front side. The two areas of electrically conductive film are electrically isolated from each other, preferably by a portion of the dielectric material separating them. The one or more leaf panels are generally rectangular in configuration and each has two extensions extending from a lower edge at its right and left corners. Both the front and back surfaces of the leaf panels carry a deposit of an electrically conductive film. The conductive film on the back surface of each leaf panel overlies the conductive film on the front surface of the next underlying leaf panel with the lowermost front piece having a conductive film on its back surface overlying one of the two areas of conductive film on the base panel. These opposed areas of conductive film are in electrical contact when a credit card or similar object is missing from, or is not inserted fully into the pocket between the opposed conductive films. The left extension of each of the leaf panels, front pieces, has a conductive film on the front surface of the corresponding front piece extending onto it and is electrically connected to one of the two areas of conductive film on the base panel. Preferably, the left extension of each front piece is bent backward, and reverse folded, so as to be interposed between the corresponding front piece and the back piece. In this manner, the conductive film on each left extension abuts one of the two areas of conductive film on the base panel. The right extension of each of the leaf panels has a conductive film on the back surface of the corresponding front piece extending onto it and is electrically connected to the other of the two areas of conductive film on the back piece. Preferably, the extensions are attached by metal rivets to the back piece, which provide electrical contact between the conductive films on the back piece and the extensions and also attach the front pieces to the back piece with pockets formed between respective pairs of leaf panels.

An alarm circuit board is secured to the front surface of a lowermost leaf panel using an adhesive. An extension from the lower edge of the base panel has conductive film and leads for connecting the two areas or sections of conductive film of the back piece with leads of the alarm circuit board. Accordingly, one lead of the alarm circuit board is connected, through one area of conductive film on the base panel, to the left extensions and the conductive films on the front surfaces of each of the leaf panels. The other lead of the alarm circuit is connected, through the other area of conductive film on the base panel, to the right extensions and the conductive films on the back surfaces of each of the front pieces. Preferably, each of these attachments is accomplished using metal pieces, such as metal rivets.

An integrated circuit comprises the alarm circuit board. The integrated circuit includes a battery, a resistor, a buzzer, and a switch.

When a wallet is closed, having the subject insert, the alarm circuit switch is closed. There is, however, another switch that needs to be closed before the circuit can be fully complete and the alarm activated. The card pockets function as the remaining switch. If the wallet is closed while the conductive film on the front surface of one of the front pieces, or the conductive area on the back piece connected with the conductive films on the front surfaces of the front pieces via the left extensions, contacts the conductive film on the back surface of another front piece the circuit will be complete and an audio alarm, i.e., the buzzer, will sound. This could occur when either a credit card, or similar object, has not been returned to its original pocket or compartment, i.e., its location before the wallet was opened, or when a credit card, or the like, has been carelessly or partially placed inside its pocket or compartment, resulting in the aforementioned electrical contact being established.

BRIEF DESCRIPTION OF THE DRAWINGS

Other objects and advantages of the present invention will become apparent from the following detailed description of a preferred embodiment thereof, taken in conjunction with the accompanying drawings, wherein:

FIG. 1 is a perspective view of a preferred embodiment of a card safety wallet in accordance with the present invention in an open position;

FIG. 2, note sheet 2, is a side view of the safety wallet in FIG. 1 taken along line section lines 2—2;

FIG. 3 is a plan view of a base panel of dielectric material for the alarm system with an electrically conductive film covering portions of one surface of the panel;

FIG. 4 is a plan view of a leaf panel or front piece of dielectric material for the alarm system with electrically conductive film covering portions of its two surfaces;

FIG. 5 is a fragmentary view of the front and back pieces of dielectric material in FIGS. 3 and 4 assembled to form a pocket for the alarm system;

FIG. 6 is a partial side view of the assembly in FIG. 5 taken along section line 6—6;

FIG. 7 is a partial side view of the assembly in FIG. 5 taken along section line 7—7;

FIG. 8 is a perspective view of a safety insert including a base panel and four leaf panels assembled to form four pockets for an alarm system in accordance with a preferred embodiment of the present invention;

FIG. 9 is a side view of the assembly in FIG. 8 viewed in the direction of line 9—9;

FIG. 10 is a side view of the assembly in FIG. 8 viewed in the direction of line 10—10; and FIG. 11 is a plan view of an alarm circuit board for the alarm system in accordance with a preferred embodiment of the present invention.

DETAILED DESCRIPTION

Context of the Invention

Referring to the drawings, wherein like numerals indicate like parts, FIG. 1 depicts a preferred embodiment of a credit card safety wallet 10. Before discussing in detail the safety wallet 10, it may be useful to briefly outline an operative environment or context of the invention. Although FIG. 1 shows a wallet of the billfold variety, the present invention has applicability to wallets and other structures for retaining credit cards, bank cards, debit cards, driver licenses, identification cards, passports, check cards, smart cards, and other similar objects. Typically, such wallet-like structures are opened for removing or inserting a credit card, or similar object, and are generally carried in a closed or folded position. Such wallets are typically made of leather or a similar material and, as illustrated in FIG. 1, have a compartment 12 for currency, a transparent compartment 14 for an identification card and a plurality of pockets 16 for credit cards, or similar object.

In the current trade, people find themselves paying with a credit card quite often, or using their identification cards, driver license and passport. There are times when the card owner makes a purchase and leaves the establishment having forgotten to reclaim the card. In order to prevent this and similar omissions with the other types of personal documentation, the present invention provides an alarm system assembled in a wallet-like structure which generates an audible alarm when a credit card has not been returned to its original pocket and the wallet is closed.

As seen in FIGS. 1 and 2, an alarm system or insert 20 is sewn or glued into the wallet 10 and fits snugly beneath and between the leather portions 22 of the card pockets 16. As shown in FIG. 1, the alarm system 20 is well hidden beneath the outer material of the wallet 10. FIG. 2 shows credit cards 24, or similar object, in the pockets 16. A card 24 is inserted and/or removed as shown in FIG. 2.

Safety Wallet

FIG. 3 shows a plan view of a base panel or back piece 30 of dielectric material, plastic for example, of the alarm system 20 (also shown in FIG. 2). The back piece or base panel 30 is generally square in shape and has a film deposit of electrically conductive material on a surface 32. The film is deposited forming two areas 34 and 36 of electrically conductive material covering the dielectric material base. The areas 34 and 36 are separated by a gap 37 so as to be electrically insulated from each other. An extension 39 extends from the lower edge (as seen in FIG. 3) of the back piece 30. Ten small apertures 38 are shown on the back piece 30. The apertures 38 may be pre-formed in the back piece 30 or may be formed during assembly of the alarm system 20, as described in further detail below.

FIG. 4 shows a front piece 40 of dielectric material of the alarm system 20 with electrically conductive film covering portions of both surfaces 42 and 44. Four such front pieces are also shown in FIG. 2. Each front piece 40 is generally rectangular in shape with two extensions 46 and 48 extending from the lower edge (as seen in FIG. 4). The conductive film on the front surface 42 extends onto the left extension 46 and the conductive film on the back surface 44 extends onto the right extension 48. The extensions 46, 48 each have a small circular aperture 49. FIG. 5 shows an assembly 50 of one back piece 30 and one front piece 40. The front piece 40 may be attached to the back piece 30 by crimping. For example, metal rivets 52 may be inserted through aligned holes 38, 49 in the pieces 30, 40, respectively, and then crimped to attach the pieces 30, 40 together. As shown in FIGS. 4 and 6, the left extension 46 of the front piece 40 is bent backward (into the plane of the paper as shown in FIG. 4), and the left aperture 49 is connected to the corresponding left aperture 38 on the back piece 30. The right extension 48 is not bent, as depicted in FIG. 7, but is directly connected to the back piece 30 at the aperture 49 by crimping with a corresponding aperture 38.

As shown in FIGS. 6 and 7, the conductive film on the front surface 42 of the front piece 40 is electrically connected with the conductive area 34 on the back piece 30 and the conductive film on the back surface 44 of the front piece 40 is electrically connected with the conductive area 36 of the back piece 30. This process is repeated for each of the three remaining front pieces 40 to form the alarm system 20 shown in FIG. 8. FIGS. 9 and 10 show side views of the alarm system 20 in FIG. 8 with the left extensions 46 and the right extensions 48, respectively, attached with the back piece 30.

FIG. 8 also shows the lower extension 39 of the back piece 30 crimped to a circuit board 60, shown in detail in FIG. 11, so that the conductive area 34 of the back piece 30 is electrically connected with terminal 62 of the circuit board 60 and the conductive area 36 of the back piece 30 is electrically connected with terminal 64 of the circuit board 60. As previously discussed, the conductive films on the front surfaces 42 of each of the front pieces 40 are electrically connected with the conductive area 34 of the back piece 30 and the conductive films on the back surfaces 44 of each of the front pieces 40 are electrically connected with the conductive area 36 of the back piece 30. As shown in FIG. 11, the circuit board 60 includes terminals 62 and 64, a buzzer device 65, a switch 66 (also shown in FIGS. 1 and 2) which is closed when the wallet 10 is closed and is open when the wallet 10 is open, a battery 67, an integrated circuit 68, and a resistor 69 electrically connected on a mounting board 70. Preferably, the switch 66 is a spring loaded switch. The mounting board 70 may be attached by adhesive to the front surface 42 of the uppermost front piece 40, as shown in FIG. 8. The circuitry of the circuit board 60 is within the scope of a person skilled in the art and, therefore, is not discussed in detail herein.

In operation, a credit card, electronic pay card, or similar object, is placed in each of the pockets 16 thereby breaking electrical contact between the conductive films on the back surfaces 44 of the front pieces 40 and the conductive area 34 of the back piece 30. Such electrical contact is established either directly as between the conductive film on the back surface 44 of the lowermost (as seen in FIG. 8) front piece 40 and the conductive area 34 of the back piece 30 or indirectly via the conductive film on the front surface 42 of an interposed front piece 40 (as in the case of the upper three front pieces) when a card is either missing from a pocket 16 or has not been inserted fully in its pocket. If a card is inserted in each pocket 16 and the wallet 10 is closed, the buzzer 65 will not sound because the electrical circuit with the battery 67 is not complete. However, if a card is missing from one or more of the pockets 16 and the wallet 10 is closed, the buzzer 65 will sound when the switch 66 is pressed by closing the wallet 10 because the circuit with the battery 67 is now closed as a result of electrical contact between conductive films on opposing surfaces of the back and front pieces 30, 40.

SUMMARY OF MAJOR ADVANTAGES OF THE INVENTION

After reading and understanding the foregoing inventive card safety wallet, in conjunction with the drawings, it will be appreciated that several distinct advantages of the subject invention are obtained. Without attempting to set forth all of the desirable features of the instant card safety wallet and insert, at least some of the major advantages of the invention include an audio alarm alerting the owner when the wallet is closed and a credit card, electronic pay card, or similar object, is not fully/securely fit into one of the card holding pockets or compartments, or when a credit card, or similar object, is not returned to the position it occupied before the wallet was opened.

Another advantage of the subject safety wallet is the configuration used in which the circuitry and materials included in the alarm system do not add significantly to the weight of the wallet.

Yet another advantage of the subject safety wallet is the configuration used and the use of materials which do not add significantly to the bulk or thickness of the wallet.

Also, the aesthetics of the wallet are unchanged in the subject safety wallet, thus adding to the advantages of the present invention.

A further advantage of the subject safety wallet is its ease of manufacture and assembly thus making it inexpensive to produce.

In describing the invention, reference has been made to a preferred embodiment. Those skilled in the art, however, and familiar with the disclosure of the subject invention, may recognize additions, deletions, substitutions, modifications, and/or other changes that will fall within the purview of the invention as defined in the claims below.

What is claimed:

1. A card safety wallet having a missing card alarm, said wallet having an open position for removing or inserting a card and a closed position for caring said wallet by a user, said missing card alarm comprising:

a missing card detecting circuit including a base panel of dielectric material;

one or more leaf panels of dielectric material having a pair of extensions on each panel, said one or more leaf panels being attached to said base panel by said pair of extensions of dielectric material to form at least one pocket for receiving at least one card within said pocket;

first and second electrically conductive film areas on said base panel and being electrically isolated;

first and second electrically conductive film surfaces on first and second opposite sides respectively of each of said one or more leaf panels, said first conductive film surface being in electrical contact with said first conductive film area of said base panel and said second conductive film surface being in electrical contact with said second conductive film area of said base panel;

a portion of said first conductive film extending onto a first extension of said pair of extensions of said one or more leaf panels and a portion of said second conductive film extending onto a second extension of said pair of extensions of said one or more leaf panels, said electrically conductive films forming a circuit for said at least one pocket for detecting when a card is missing from said at least one pocket; and an alarm circuit, electrically connected with said missing card detecting circuit, said alarm circuit having a switch which is closed when said wallet is closed and open when said wallet is open, wherein said alarm emits a signal when said wallet is closed without a card being contained within said at least one pocket of said card safety wallet.

2. A card safety wallet as defined in claim 1, wherein said detecting circuit includes:

a first extension of each leaf panel being folded, reversely bent, and attached to said base panel on said first conductive film area to provide electrical contact between said first conductive film surface of said leaf panel and said first conductive film area of said base panel, and a second extension of each leaf panel being attached to said base panel on said second conductive film area to provide electrical contact between said second conductive film surface of said one or more leaf panels and said second conductive film area of said base panel;

said alarm being connected with said detecting circuit through a pair of leads connected with said first and second electrically conductive film areas, respectively, of said base panel.

3. A card safety wallet as defined in claim 2, wherein said one or more leaf panels comprises:

a set of four leaf panels arranged in an overlapping cascade wherein each of said first extension is reversely bent and attached at spaced locations to said first conductive film areas of said base panel and each of said second extensions is attached to spaced locations of second conductive film areas of said base panel to define a corresponding plurality of said pockets for receiving cards and an initial leaf panel of said plurality of leaf panels overlying said base panel, wherein the first conductive film area of said base panel is opposed to the second electrically conductive film surface of the initial leaf panel and the first electrically conductive film surface of the initial leaf panel is opposed to the first conductive film surface of the next sequential leaf panel in the cascade of leaf panels wherein a card inserted within the pockets formed by said leaf panels will serve to electrically insulate contact between opposing surfaces of next adjacent leaf panels.

4. A card safety wallet as defined in claim 3 wherein:

each leaf panel of said plurality of leaf panels comprises a generally rectangular sheet of plastic and said pair of extensions extends from a lower edge of said leaf panel.

5. A card safety wallet as defined in claim 3 wherein:

said base panel comprises a generally square sheet of plastic, said first and second conductive film areas of said base panel being deposited on one surface of said base panel and a gap extending between said first and second conductive film areas for electrically isolating said first and second conductive areas from each other on said base panel.

6. A card safety wallet as defined in claim 3 wherein:

rivets attach each of said extensions of said leaf panels to said base panel.

7. A card safety wallet as defined in claim 3 wherein:

said alarm circuit includes a battery, a first terminal of said battery connected with said second conductive film area of said base panel and a second terminal of said battery connected to an integrated circuit; a resistor connected with said integrated circuit; a buzzer connected with said integrated circuit; and said switch of said alarm circuit having one lead connected to said integrated circuit and a second lead connected to said first conductive film area of said base panel.

8. A card safety wallet as defined in claim 7 wherein:

said alarm circuit being secured to but electrically isolated from a first electrically conductive film surface of a leaf panel adjacent a lower most leaf panel of said cascade of leaf panels.

9. A card safety wallet as defined in claim 7 wherein:

said switch is a spring loaded, normally open, switch.

10. A card safety wallet as defined in claim 1 wherein:

said signal comprises an audio alarm.

11. A card safety wallet as defined in claim 1 wherein:

said card safety wallet includes a leather wallet covering fashioned about said missing card detecting circuit and said alarm circuit.

12. A missing card detecting and alarm insert for a wallet having at least one pocket to receive at least one card, said missing card and alarm insert comprising:

a missing card detecting circuit including a base panel of dielectric material;

one or more leaf panels of dielectric material having a pair of extensions on each panel, said one or more leaf panels being attached to said base panel by said pair of extensions of dielectric material to form at least one pocket for receiving at least one card within said pocket;

first and second electrically conductive film areas on said base panel and being electrically isolated;

first and second electrically conductive film surfaces on first and second opposite sides respectively of each of said one or more leaf panels, said first conductive film surface being in electrical contact with said first conductive film area of said base panel and said second conductive film surface being in electrical contact with said second conductive film area of said base panel;

a portion of said first conductive film extending onto a first extension of said pair of extensions of said one or more leaf panels and a portion of said second conductive film extending onto to a second extension of said one or more leaf panels, said electrically conductive films forming a circuit for said at least one pocket for detecting when a card is missing from said at least one pocket; and an alarm circuit, electrically connected with said missing card detecting circuit, said alarm circuit having a switch being responsive to an open and closed position of a wallet when said circuit is placed within a wallet, wherein said alarm operably emits a signal when said circuit is fitted within a wallet and the wallet is closed without a card being contained within each card pocket of the wallet.

13. A missing card detecting and alarm insert for a wallet having at least one pocket to receive at least one card as defined in claim 12 wherein said detecting circuit includes:

a first extension of each leaf panel being folded, reversely bent, and attached to said base panel on said first conductive film area to provide electrical contact between said first conductive film surface of said leaf panel and said first conductive film area of said base panel, and a second extension of each leaf panel being attached to said base panel on said second conductive film area to provide electrical contact between said second conductive film surface of said one or more leaf panels and said second conductive film area of said base panel;

said alarm being connected with said detecting circuit through a pair of leads connected with said first and second electrically conductive film areas, respectively, of said base panel.

14. A missing card detecting and alarm insert for a wallet having at least one pocket to receive at least one card as defined in claim 13 wherein:

each leaf panel of said one or more leaf panels comprises a generally rectangular sheet of plastic and said pair of extensions extends from a lower edge of said one or more leaf panels.

15. A missing card detecting and alarm insert for a wallet having at least one pocket to receive at least one card as defined in claim 14 wherein:

said base panel comprises a generally square sheet of plastic, said first and second conductive film areas of said base panel being deposited on one surface of said base panel and a gap extending between said first and second conductive film areas for electrically isolating said first and second conductive areas from each other on said base panel.

16. A missing card detecting and alarm insert for a wallet having at least one pocket to receive at least one card as defined in claim 15 wherein:

said alarm circuit includes a battery, a first terminal of said battery connected with said second conductive film area of said base panel and a second terminal of said battery connected to an integrated circuit; a resistor connected with said integrated circuit; a buzzer connected with said integrated circuit; and said switch of said alarm circuit having one lead connected to said integrated circuit and a second lead connected to said first conductive film area of said base panel.

17. A card safety wallet with a missing card alarm said card safety wallet having an open position for removing or inserting cards and a closed position for carrying the wallet, said card safety wallet comprising:

a base panel composed from a plastic dielectric material having first and second electrically conductive areas;

a plurality of leaf panels composed of plastic dielectric material, each leaf panel having a first and second electrically conductive film on front and back surfaces thereof, and a first and second extension projecting from an edge of each said leaf panel, said first electrically conductive film of each of said leaf panels extending onto said first extension and said second conductive film extending onto said second extension;

said plurality of leaf panels being structured and arranged on said base panel to define a plurality of pockets for receiving cards, said second conductive film of one of said leaf panels being opposed to said first conductive area of said base panel and in electrical contact with said first conductive area when a card is missing from said corresponding pocket, said second conductive film of each of said other leaf panels of said plurality of leaf panels being opposed to said first conductive film of an underlying leaf panel in an electrical contact with said first conductive film of said underlying leaf panel when a card is missing from said corresponding pocket;

first extension of each leaf panel being bent and reverse folded to provide electrical contact between said first conductive firm of each leaf panel and said first conductive area of said base panel and said second extension of each leaf panel being in electrical contact between said second conductive film of each leaf panel and said second conductive area of said base panel;

an alarm, electrically connected with said first and second conductive areas of said base panel; and a switch connected to said alarm, said switch being closed when said wallet is closed and open when said wallet is open, wherein said alarm operates when said wallet is closed without a card in each pocket and is inoperative when said wallet is closed with a card fully inserted in each pocket.

18. A card safety wallet as defined in claim 17 wherein:

a pair of rivets attaches each said leaf panel to said base panel at said first and second extensions.

19. A card safety wallet as defined in claim 17 wherein:

said first and second conductive areas of said base panel are on a front surface thereof, a gap extends between said first and second conductive areas for electrically isolating said first and second conductive areas from each other.

20. A card safety wallet as defined in claim 19 wherein:

said first and second conductive films of each of said leaf panels are on opposite sides of each said leaf panel.

21. A safety wallet as defined in claim 17 wherein:

said alarm comprises a battery, a first terminal of said battery connected with said second conductive area of said base panel and a second terminal of said battery connected with an integrated circuit;

a resistor connected to said integrated circuit;

a buzzer connected to said integrated circuit; and a switch having one lead connected to said integrated circuit and a second lead connected to said first conductive area of said base panel.

* * * * *